US005195737A

United States Patent [19]

Ifkovits, Jr. et al.

[11] Patent Number: 5,195,737

[45] Date of Patent: Mar. 23, 1993

[54] ANTI-SKEW DEVICE FOR SINGULATING FEEDER

[75] Inventors: Edward M. Ifkovits, Jr.; Edward F. Ifkovits, Sr., both of New Fairfield, Conn.

[73] Assignee: Pitney Bowes Inc., Stamford, Conn.

[21] Appl. No.: 826,329

[22] Filed: Jan. 24, 1992

[51] Int. Cl.[5] ..... B65H 3/04

[52] U.S. Cl. ..... 271/35; 271/116; 271/125; 271/150; 198/817; 198/835

[58] Field of Search ..... 271/2, 34, 35, 116, 271/121, 122, 150, 151, 125, 124, 149, 275; 198/817, 834, 835

[56] References Cited

U.S. PATENT DOCUMENTS

| | | | |
|---|---|---|---|
| 1,377,810 | 5/1921 | Escobales | 271/35 X |
| 3,193,282 | 7/1965 | Stewart | 271/35 X |
| 3,372,925 | 3/1968 | De Vries et al. | 271/116 X |
| 3,642,271 | 2/1971 | Davis | 271/116 |
| 3,831,928 | 8/1974 | Davis | 271/35 |
| 4,039,180 | 8/1977 | Stocker | 271/116 |
| 5,100,125 | 3/1992 | Uplinger et al. | 271/275 |

*Primary Examiner*—D. Glenn Dayoan
*Assistant Examiner*—Boris Milef
*Attorney, Agent, or Firm*—Charles R. Malandra, Jr.; Melvin J. Scolnick

[57] ABSTRACT

A belt feeding assembly for feeding paper sheets. The assembly includes: a pair of side frames; an upstream shaft and a downstream shaft mounted in the side frames; a first timing pulley and a second timing pulley each having a one-way clutch for mounting on the downstream shaft; a third timing pulley and a fourth timing pulley each having a one-way clutch for mounting on the upstream shaft; a first timing belt mounted on the first and third pulleys; a second timing belt mounted on the second and fourth pulleys; and a device for driving the first and second timing belts, whereby when the first and second timing belts are initially driven at the start of operation, the one-way clutches enable the timing belts to properly and precisely seat in the timing pulleys.

4 Claims, 6 Drawing Sheets

ANTI-SKEW DEVICE FOR SINGULATING FEEDER

BACKGROUND OF THE INVENTION

The instant invention relates to a belt feeder for feeding sheets of paper from an upstream supply to downstream apparatus and further processing. More particularly, the invention relates to the pulleys used with the feeding belts which assure that the sheets of paper are advanced without the introduction of skew to the advancing paper.

Mechanisms for the feeding of paper documents generally fall into two categories, those being vacuum fed and friction fed. The following description of the prior art will deal only with those types of feeders an material handlers which are considered to be friction-type feeders and which include singulators.

Friction feeders are preferred when it comes to feeding single paper documents. Friction feeders, as the name implies, rely on the interaction of several components that result in the singulation of paper documents. Two methods of singulation are provided by friction feeders. One style is via top feed and the second style is via bottom feed. A friction feeder is designed to operate as a top feed or a bottom feed, but it cannot operate in both modes. The components are usually a drive roller and a retarding device. The retarding device is of a material which provides a high coefficient of friction between the paper being fed and the drive roller.

In a bottom feed configuration, the paper begins as a vertical stack placed on a plurality of belts which usually are supported by a feeder table. This plurality of belts then advance the stack of paper toward a retarding device. As the plurality of belts advance the stack of paper under the retarding device, the friction between the belts and the bottom of the stack of paper tends to pull paper off the bottom of the stack. The retarding device provides the friction that acts to hold back the stack of paper. Therefore, the number of paper documents that are pulled from the bottom of the vertical stack is determined by the physical distance between the belts and the retarding device. If the distance is substantially the thickness of a single piece of paper, or the thickness of the material being singulated, a single paper will be delivered from the bottom of the stack. The single sheet delivery is generally the desired result. If the distance between the belts and the retarding device is the thickness of several pieces of paper or of the documents to be singulated, then a stream of paper documents will be delivered from the stack.

Typical singulating feeders employ two timing belts each of which rides on two or more timing pulleys which are removably secured (typically by screws) to shafts which rotate and drive the belts. The shafts include a flat to receive a set screw through the pulley. Unfortunately, when such a singulating feeder is first started, there is usually some slippage, however minute, between the pulley and the shaft, which results in one belt fitting on its pulleys differently than the other belt fits on its pulleys. Typically, the teeth of one belt will fit on its supporting pulleys in such a way that the belt will not be driven by the pulleys, but rather is being pulled along, resulting in excess wear and tear on the other belt, which winds up being the only belt to be positively driven. Also, one belt will tend to become angled with respect to the other belt, and this lack of parallel belts will introduce skew to the documents being fed by the belts. Such arrangements allow for the documents being fed by the belts to become skewed prior to their contacting the separator stone which means the documents emerge from the separator stone skewed, which causes problems with downstream processing of the documents. Accordingly, the instant invention provides apparatus which maintains the timing belts parallel and properly seated on the pulleys at the start of operation and eliminates skew from a singulating feeder and assures that the documents exiting the singulator emerge without any skew.

SUMMARY OF THE INVENTION

Thus, the instant invention provides a belt feeding assembly, comprising: a pair of side frames; an upstream shaft and a downstream shaft mounted in said side frames; a first timing pulley and a second timing pulley each having a one-way clutch for mounting on said downstream shaft; a third timing pulley and a fourth timing pulley each having a one-way clutch for mounting on said upstream shaft; a first timing belt mounted on said first and third pulleys; a second timing belt mounted on said second and fourth pulleys; and means for driving said first and second timing belts, whereby when said first and second timing belts are initially driven at the start of operation, said one-way clutches enable said timing belts to properly and precisely seat in said timing pulleys.

DETAILED DESCRIPTION OF THE PREFERRED EMBODIMENT

Figure 1:
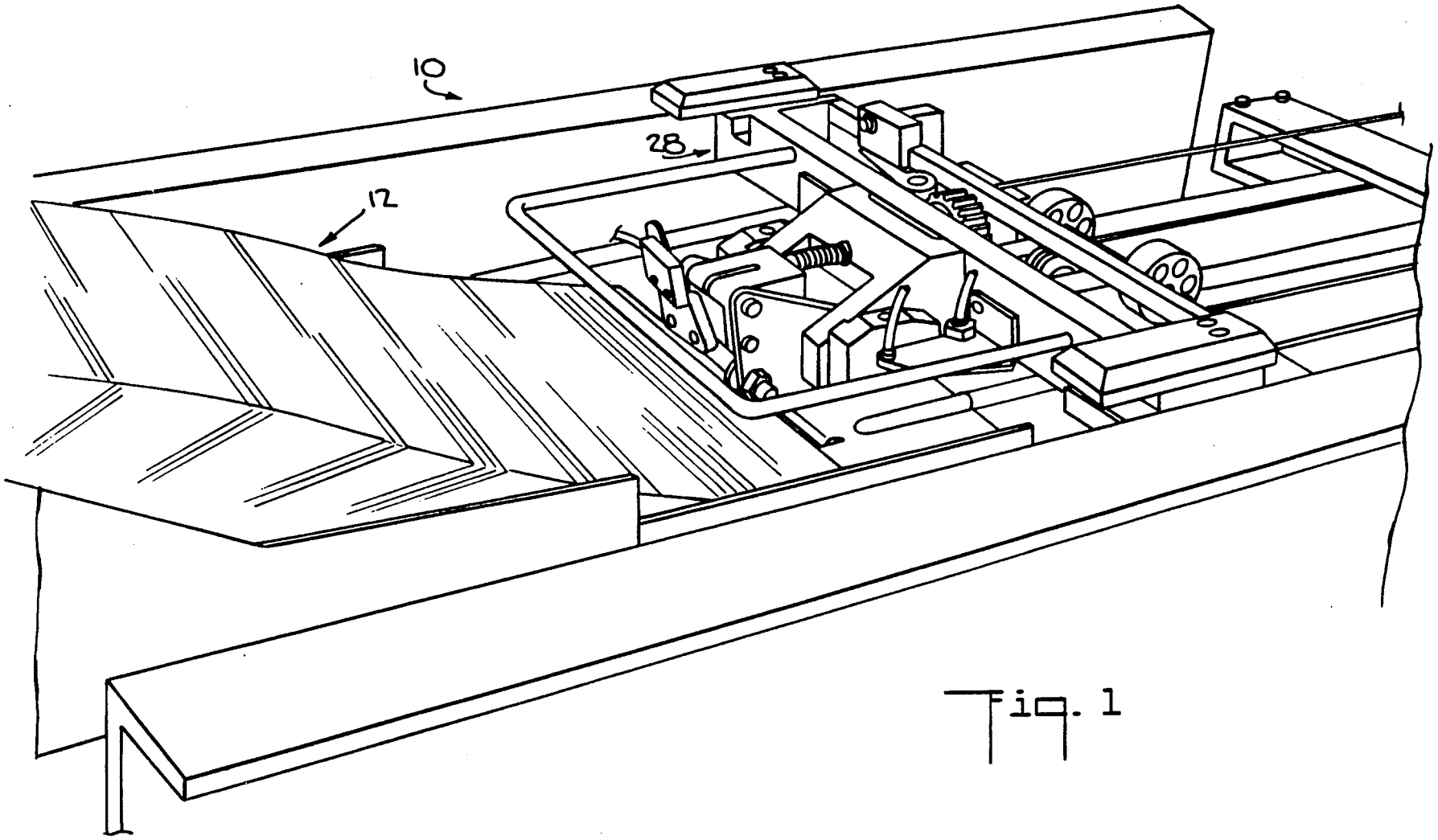
FIG. 1 is a perspective view of a separating device in a document feeder in accordance with the instant invention.
Figure 2:
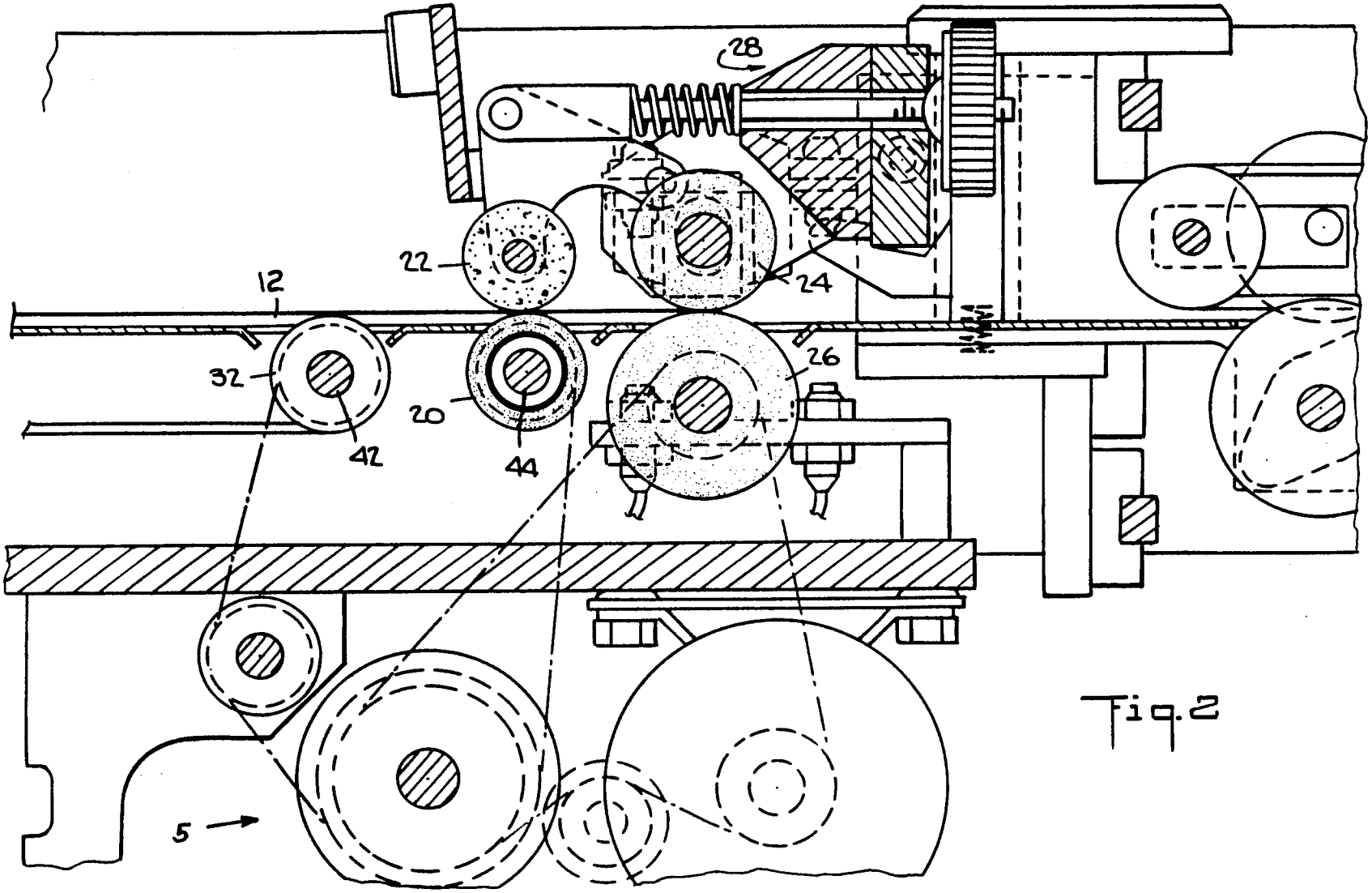
FIG. 2 is a vertical, sectional view of the apparatus seen in FIG. 1.
Figure 3:
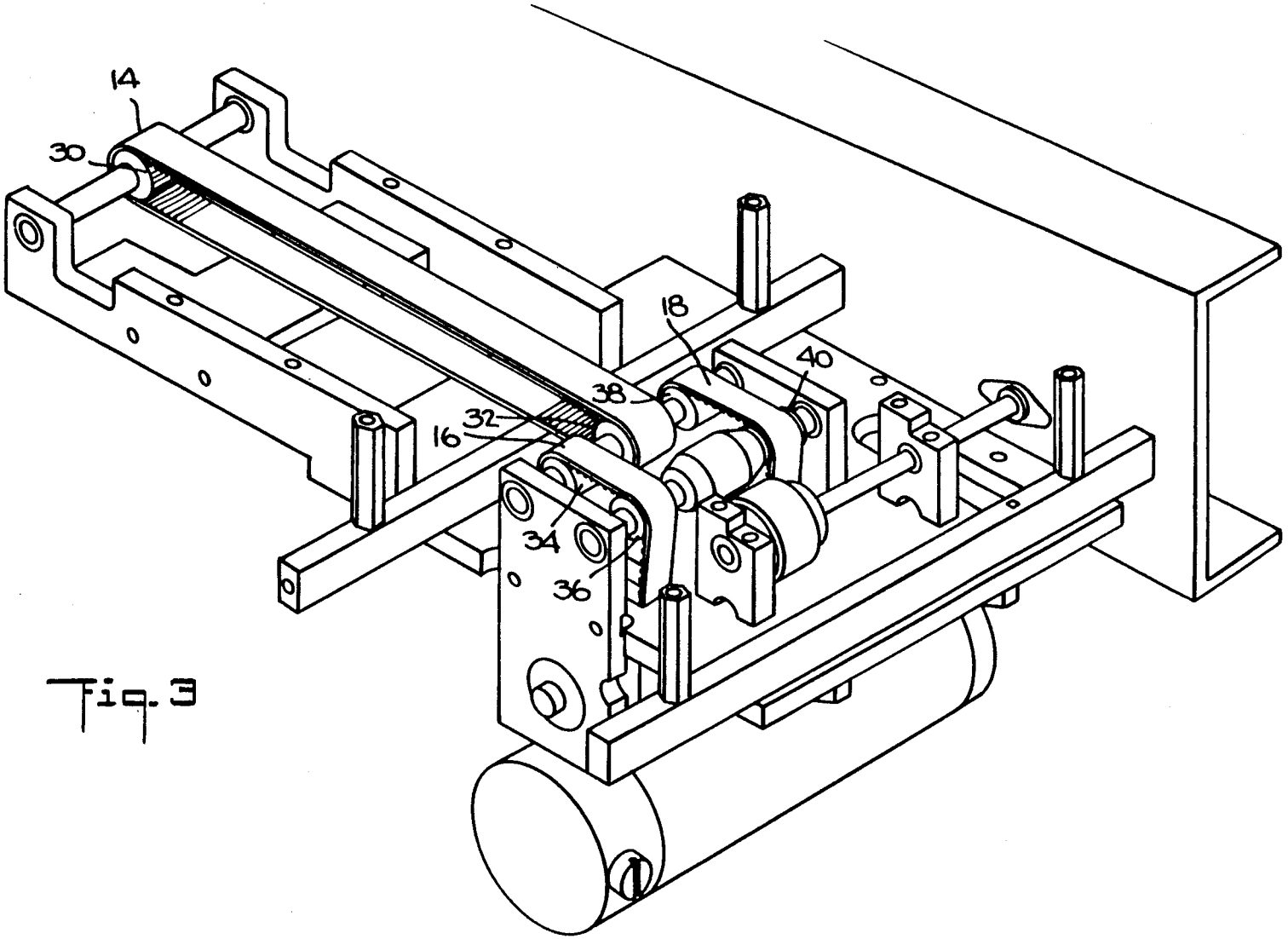
FIG. 3 is a perspective view of the lower driving belt assembly seen in FIG. 2.
Figure 4:
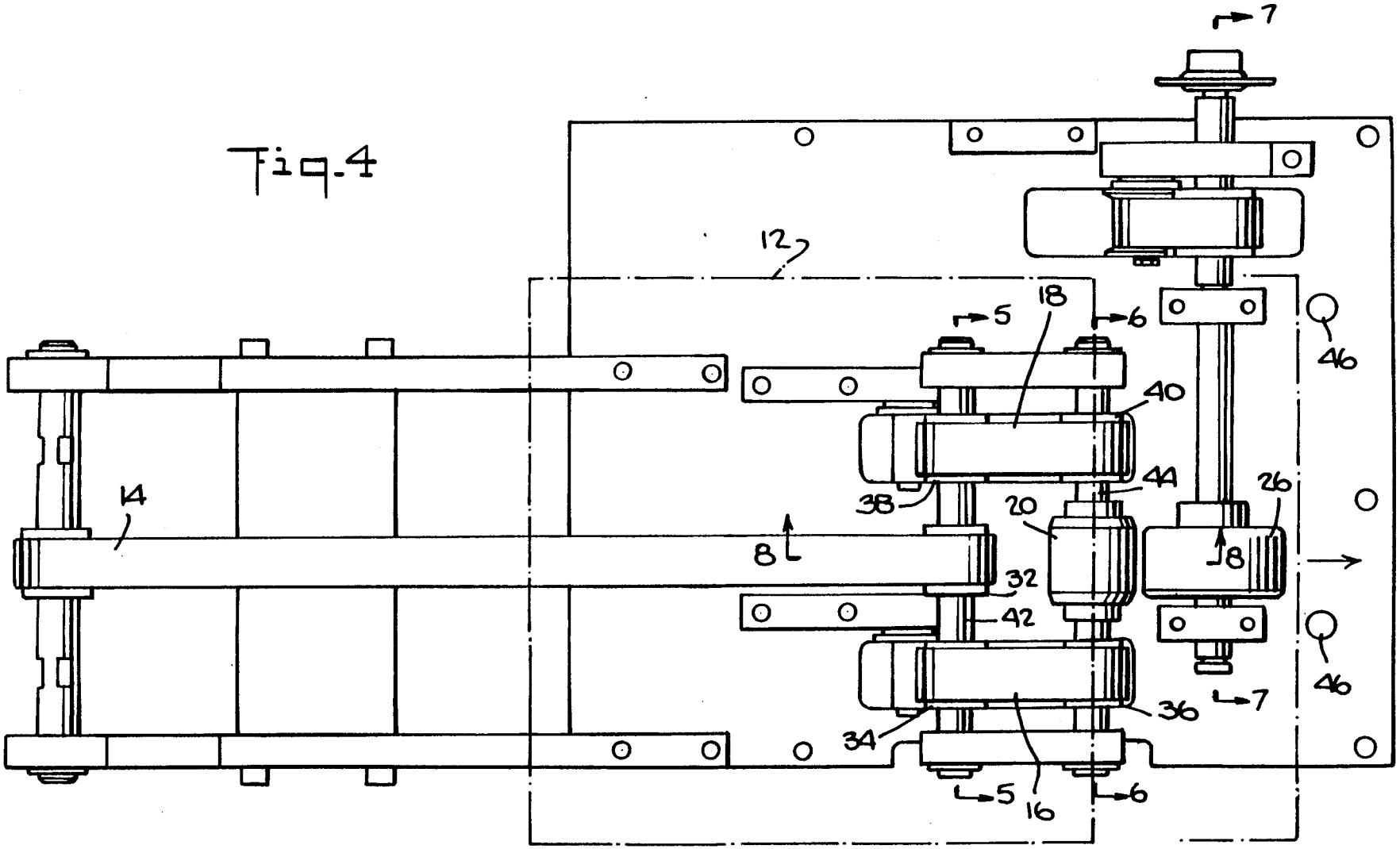
FIG. 4 is a top, plan view of the apparatus seen in FIG. 3.
Figure 5:
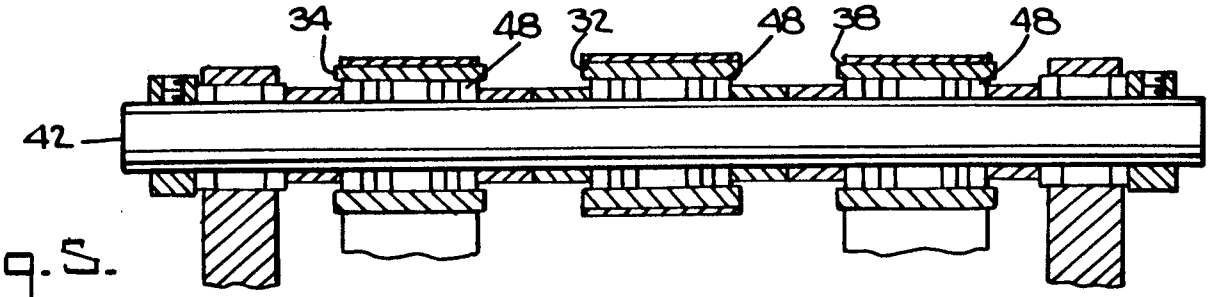
FIG. 5 is a sectional view taken on the plane indicated by the line 5—5 in FIG. 4.
Figure 6:
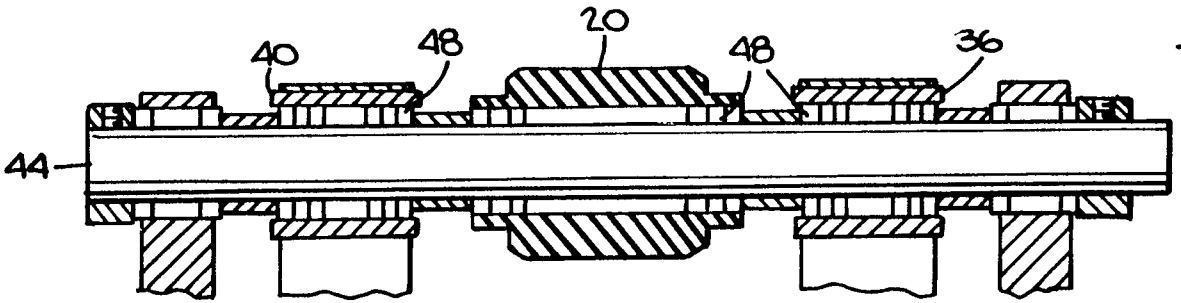
FIG. 6 is a sectional view taken on the plane indicated by the line 6—6 in FIG. 4.
Figure 7:
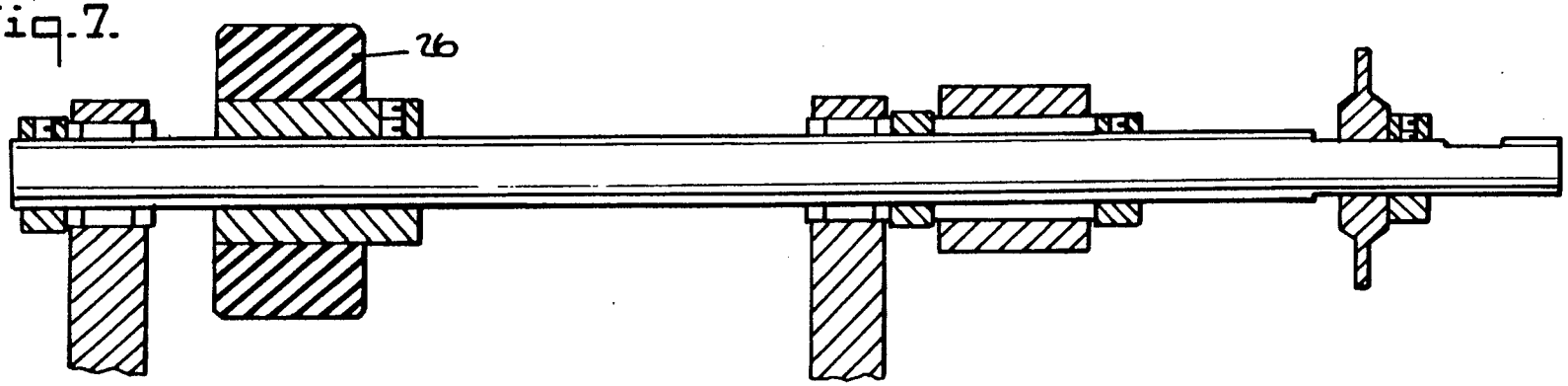
FIG. 7 is a sectional view taken on the plane indicated by the line 7—7 in FIG. 4.

In describing the preferred embodiment of the instant invention, reference is made to the drawings wherein there is seen a paper feeding module 10 for feeding and singulating a stream of paper sheets 12 from an upstream position to a downstream position where they will be further processed and ultimately inserted into an envelope. An intermittently driven belt 14 (see FIG. 3) feeds the sheets 12 toward a pair of intermittently driven belts 16 and 18. At the downstream end of the belts 16 and 18 are a separating roller 20 and a separating stone 22 located above the roller 20 (see FIG. 2). The separating roller 20 is intermittently driven in the same manner as the belts 14, 16 and 18.

Downstream of the separator stone 22 are a pair of continuously running take-away rollers 24 and 26 for conveying the sheets of paper 12 downstream in singulated fashion seriatim. The upper take-away roller 24 and the separator stone 22 are mounted in a pivotable housing generally designated 28.

The driven, timing belt 14 is mounted, inter alia, on a timing pulley 30 and a timing pulley 32. The driven timing belt 16 has its upper reaches mounted on timing pulleys 34 and 36 while the timing belt 18 has its upper reaches mounted on timing pulleys 38 and 40. The timing pulleys 32, 34 and 38 are all mounted with a one-way clutch on a shaft 42, and the separating roller 20 and the timing pulleys 36 and 40 are all mounted with a one-way clutch on a shaft 44. Situated downstream of the take-away rollers 24 and 26 are a pair of photo-sensors 46 which sense the leading and trailing edges of the paper sheets 12 and control the running and stopping of the belts 16 and 18 and the separating roller 20.

Figure 8:
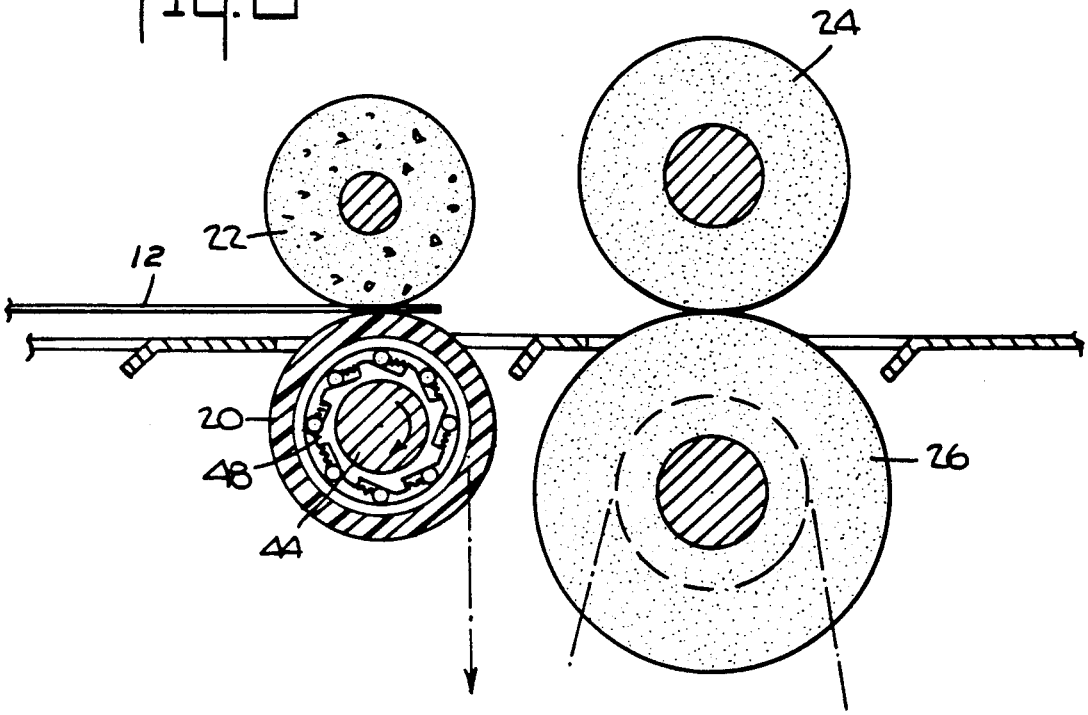
FIG. 8 is a sectional view taken on the plane indicated by the line 8—8 in FIG. 4.
Figure 9:
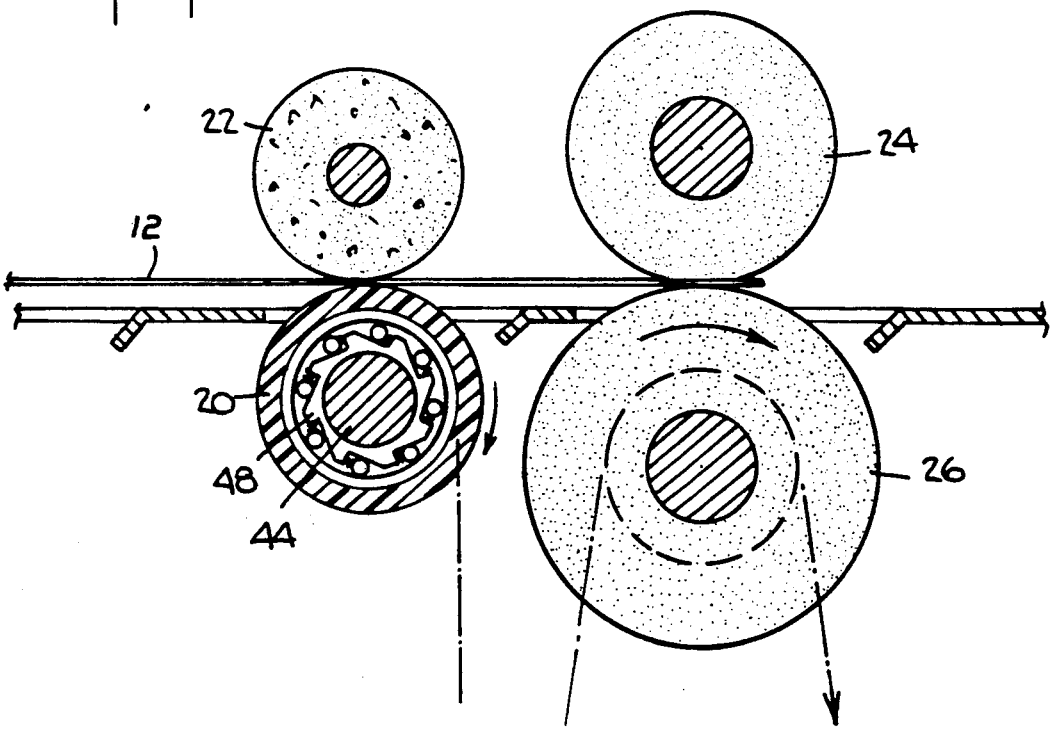
FIG. 9 is similar to FIG. 8 but shows the one-way clutch in the separating roller disengaged.

When the module 10 has been idle and it is desired to begin operation, it is imperative that the timing belts 16 and 18 be precisely seated in the timing pulleys 34, 36, 38 and 40. When the belts 16 and 18 are driven by their respective drive train (shown generally as 5 in FIG. 2 but no described, as their operation is conventional), the teeth of the belts 16 and 18 will engage the teeth of the pulleys 34, 36, 38 and 40, and because the pulleys 34, 36, 38 and 40 are mounted on one-way clutches 48 (shown in FIGS. 8 and 9 with respect to the separating roller 20), the pulleys 34, 36, 38 and 40 are free to rotate clockwise if necessary and provide appropriate alignment for the teeth of the belts 16 and 18 to properly and precisely seat in the teeth of the pulleys 34, 36, 38 and 40.

Once the belts 16 and 18 are properly seated at start-up, parallel alignment of the belts 16 and 18 is assured, and thus the feeding of paper sheets 12 to the separating roller 20 and the separating stone 22 without the introduction of skew is assured.

It is thought that the foregoing invention and many of its attendant advantages will be understood from the foregoing description and it will be apparent that various changes may be made in the form, construction and arrangement of the parts thereof without departing from the spirit and scope of the invention or sacrificing all of its material advantages, the form hereinbefore described being merely a preferred or exemplary embodiment thereof.

What is claimed is:

1. A belt feeding assembly, comprising:

a pair of side frames;

an upstream and a downstream shaft mounted in said side frames;

a first timing pulley and a second timing pulley each having a one-way clutch for mounting on said downstream shaft;

a third timing pulley and a fourth timing pulley each having a one-way clutch for mounting on said upstream shaft;

a first timing belt mounted on said first and third pulleys;

a second timing belt mounted on said second and fourth pulleys; and means for driving said first and second timing belts, whereby when said first and second timing belts are initially driven at the start of operation, said one-way clutches enable said timing belts to properly and precisely seat in said timing pulleys.

2. The assembly of claim 1, wherein said belt feeding assembly feeds paper documents.

3. The assembly of claim 2, additionally comprising document separating apparatus located downstream of said timing belts.

4. The assembly of claim 3, wherein said document separating apparatus includes a separating roller and a separating stone mounted in said side frames, whereby said paper documents enter said separating roller and said separating stone without skew.

* * * * *